US010138090B2

(12) United States Patent
Nakano et al.

(10) Patent No.: US 10,138,090 B2
(45) Date of Patent: Nov. 27, 2018

(54) ELEVATOR CAR ROLLING SUPPRESSION DEVICE AND METHOD

(71) Applicant: FUJITEC CO., LTD., Hikone-shi (JP)

(72) Inventors: Takahiro Nakano, Hikone (JP); Motoki Kaneko, Hikone (JP)

(73) Assignee: FUJITEC CO., LTD., Hikone-shi (JP)

( * ) Notice: Subject to any disclaimer, the term of this patent is extended or adjusted under 35 U.S.C. 154(b) by 333 days.

(21) Appl. No.: 15/071,517

(22) Filed: Mar. 16, 2016

(65) Prior Publication Data

US 2016/0272465 A1 Sep. 22, 2016

(30) Foreign Application Priority Data

Mar. 20, 2015 (JP) ..... 2015-058448

(51) Int. Cl.
*B66B 1/34* (2006.01)
*B66B 1/30* (2006.01)
*B66B 7/04* (2006.01)

(52) U.S. Cl.
CPC ..... *B66B 1/30* (2013.01); *B66B 7/042* (2013.01); *B66B 1/3492* (2013.01)

(58) Field of Classification Search
CPC ..... B66B 1/30; B66B 7/042; B66B 1/3492
USPC ..... 187/247, 292, 391, 393, 394, 409, 410
See application file for complete search history.

(56) References Cited

U.S. PATENT DOCUMENTS 4,750,590 A 6/1988 Otala
5,329,077 A * 7/1994 Skalski ..... B66B 1/00 104/129
5,524,730 A 6/1996 Roberts
5,544,721 A * 8/1996 Roberts ..... B66B 7/043 187/292
5,765,663 A * 6/1998 Jamieson ..... B66B 7/041 187/292
5,866,861 A * 2/1999 Rajamani ..... B66B 7/044 187/292
5,896,949 A * 4/1999 Hamdy ..... B66B 7/027 187/292
6,494,295 B2 * 12/2002 Grundmann ..... B66B 11/028 187/292

(Continued)

FOREIGN PATENT DOCUMENTS

CN 1134392 A 10/1996
CN 100343152 C 10/2007

(Continued)

*Primary Examiner* — Anthony Salata
(74) *Attorney, Agent, or Firm* — The Webb Law Firm

(57) ABSTRACT

An elevator car rolling suppression device capable of suppressing rolling of an elevator car includes a drive unit configured to press a guide unit against a guide rail. The device also includes a position detecting unit configured to detect a position of an elevator car within a shaft, a storage unit configured to store the position of the elevator car within the shaft and an acceleration of the elevator car in association with each other. The device also includes a control unit configured to extract the acceleration in the lateral direction of the elevator car detected by the position detecting unit from the storage unit. The control unit also controls the drive unit so as to adjust the pressing force of the guide unit against the guide rail to a pressing force that is derived from at least the extracted acceleration in the lateral direction of the elevator car.

14 Claims, 6 Drawing Sheets

(56) References Cited

U.S. PATENT DOCUMENTS

| | | | | |
|---|---|---|---|---|
| 7,014,013 | B2 * | 3/2006 | Fujita | B66B 7/044 187/292 |
| 9,242,837 | B2 * | 1/2016 | Wang | B66B 7/043 |
| 9,896,306 | B2 * | 2/2018 | Boschin | B66B 5/02 |
| 2005/0279588 | A1 | 12/2005 | Fujita | |
| 2006/0243537 | A1 | 11/2006 | Finn et al. | |
| 2013/0001023 | A1 | 1/2013 | Leutenegger et al. | |

FOREIGN PATENT DOCUMENTS

| | | | |
|---|---|---|---|
| CN | 103523635 | A | 1/2014 |
| GB | 2262166 | A | 6/1993 |
| JP | 6274897 | A | 4/1987 |
| JP | 4338083 | A | 11/1992 |
| JP | 5155558 | A | 6/1993 |
| JP | 200560001 | A | 3/2005 |
| JP | 2006525925 | A | 11/2006 |
| JP | 4816649 | B2 | 11/2011 |
| JP | 201310638 | A | 1/2013 |
| WO | 2007091335 | A1 | 8/2007 |

* cited by examiner

ELEVATOR CAR ROLLING SUPPRESSION DEVICE AND METHOD

CROSS-REFERENCE TO RELATED APPLICATION

This application claims priority to Japanese Patent Application No. 2015-58448 filed Mar. 20, 2015, the disclosure of which is hereby incorporated in its entirety by reference.

BACKGROUND OF THE INVENTION

Field of the Invention

The present invention relates to an elevator car rolling suppression device configured to suppress rolling of an elevator car during elevation and a method for suppressing the rolling of the elevator car.

Background Art

In general, an elevator includes: an elevator car provided to be elevatable within a shaft provided in a building; a driving source to move up and down the elevator car; a guide rail fixed to the building and extending in the vertical direction along the shaft; a guide unit attached directly or indirectly to the elevator car and being movable along the guide rail; and a counter weight configured to move up and down in conjunction with the elevator car in order to reduce the load of the driving source.

Such an elevator of this type moves the guide unit along the guide rail, thereby moving up and down the elevator car in a specific path within the shaft.

Meanwhile, the guide rail is constructed by joining a plurality of rail members. Accordingly, the guide unit moves along the joint of the rail members or the bending of the rail members.

Therefore, when the relative arrangement between the guide unit and the elevator car is constant, the elevator car during elevation follows the same path as the path of the guide unit, as a result of which the elevator car swings in the lateral direction orthogonal to the vertical direction. Further, the elevator car during elevation may sometimes swing in the lateral direction due to the effect of wind pressure or the like caused when it passes by the counter weight.

In view of such problems, an elevator provided with a car rolling suppression device configured to suppress the swing (rolling) in the lateral direction of the elevator car during elevation has been provided.

The car rolling suppression device includes: a drive unit configured to press a guide unit against a guide rail; a measuring unit configured to measure acceleration in the lateral direction of an elevator car during elevation; a control unit configured to control the drive unit so as to adjust the pressing force of the guide unit against the guide rail to a pressing force that is derived based on the acceleration in the lateral direction of the elevator car measured by the measuring unit (see WO 2007/091335 A).

The car rolling suppression device of this type adjusts the pressing force of the guide unit against the guide rail to a pressing force that is derived based on the acceleration (measured value) in the lateral direction of the elevator car, thereby allowing a reaction force against the pressing force of the guide unit acting on the guide rail to counteract a force in the lateral direction to be caused by rolling of the elevator car. Thus, the car rolling suppression device of this type is assumed to be capable of moving up and down the elevator car without rolling.

Meanwhile, the car rolling suppression device with the above-described configuration has a time difference between the timing at which the measuring unit measures the acceleration and the timing at which the control unit controls the drive unit, because the measuring unit measures the acceleration of the elevator car that is actually moving up and down, and thereafter the control unit controls the drive unit based on the measurement result of the measuring unit.

Further, the elevator car during elevation has its position in the vertical direction within the shaft changing every moment, and therefore, the car rolling suppression device with the above-described configuration exerts the pressing force of the guide unit derived based on the measurement result at a position different from the original position at which a pressing force that is derived based on the measurement result by the measuring unit is supposed to be exerted. That is, the conventional car rolling suppression device exerts a different pressing force from the original pressing force that is supposed to be exerted in order to absorb rolling of the elevator car at a position where the elevator car passes.

Therefore, the car rolling suppression device with the above-described configuration has a problem of being incapable of practically absorbing rolling of the elevator car.

SUMMARY OF THE INVENTION

It is therefore an object of the present invention to provide an elevator car rolling suppression device capable of suppressing rolling of an elevator car more reliably, and a method for suppressing the rolling of the elevator car.

An elevator car rolling suppression device according to the present invention includes: a drive unit attached to an elevator car provided to be elevatable within a shaft provided in a building, the drive unit being configured to press, against a guide rail, a guide unit provided to be movable along the guide rail extending in the vertical direction along the shaft, the guide unit being configured to restrict movement of the elevator car in the lateral direction orthogonal to the vertical direction; a position detecting unit configured to detect a position of the elevator car in the vertical direction within the shaft; a storage unit configured to store in advance the position of the elevator car in the vertical direction within the shaft and an acceleration in the lateral direction of the elevator car at the position of the elevator car in association with each other; and a control unit configured to extract, based on the position of the elevator car detected by the position detecting unit, the acceleration in the lateral direction of the elevator car stored in association with the stored position of the elevator car corresponding to the position of the elevator car where the elevator car is about to pass from the storage unit, and to control the drive unit so as to adjust the pressing force of the guide unit against the guide rail to a pressing force that is derived based on at least the extracted acceleration in the lateral direction of the elevator car, in response to the detection of the position of the elevator car by the position detecting unit.

According to one aspect of the elevator car rolling suppression device according to the present invention, the configuration may be such that the elevator car rolling suppression device further includes: a speed measuring unit configured to measure an elevation speed of the elevator car, wherein the storage unit stores in advance a plurality of elevation patterns in each of which at least one of the departure floor and the destination floor of the elevator car is different, and the elevation speed of the elevator car at a specific position in the vertical direction within the shaft is different, and further stores the position of the elevator car in the vertical direction within the shaft and the acceleration in the lateral direction of the elevator car at the position of the elevator car for each of the plurality of elevation patterns; and the control unit extracts, based on the position of the elevator car detected by the position detecting unit and the elevation speed of the elevator car measured by the speed measuring unit, the elevation pattern from the storage unit, further extracts, based on the position of the elevator car detected by the position detecting unit and the extracted elevation pattern, the acceleration of elevator car in the lateral direction stored in association with the stored position of the elevator car corresponding to the position of the elevator car detected by the position detecting unit from the storage unit, and controls the drive unit so as to adjust the pressing force of the guide unit against the guide rail to a pressing force that is derived based on the extracted acceleration in the lateral direction of the elevator car, in response to the detection of the position of the elevator car by the position detecting unit.

Further, according to another aspect of the elevator car rolling suppression device according to the present invention, the configuration may be such that the control unit controls the drive unit so as to adjust the pressing force of the guide unit against the guide rail to a pressing force that is derived based on the extracted acceleration in the lateral direction of the elevator car, in response to the detection of the position of the elevator car by the position detecting unit, when the elevation speed of the elevator car is a specific speed.

According to still another aspect of the elevator car rolling suppression device according to the present invention, the configuration may be such that the elevator car rolling suppression device further includes: an acceleration measuring unit configured to measure the acceleration in the lateral direction of the elevator car, wherein the acceleration measuring unit measures the acceleration in the lateral direction of the elevator car during elevation, and the control unit rewrites the acceleration of the elevator car that is stored in the storage unit in association with the stored position of the elevator car in the vertical direction corresponding to the position of the elevator car detected by the position detecting unit, with the acceleration of the elevator car detected by the acceleration measuring unit.

According to still another aspect of the elevator car rolling suppression device according to the present invention, the configuration may be such that the elevator car rolling suppression device further includes: an acceleration measuring unit configured to measure the acceleration in the lateral direction of the elevator car, wherein the control unit controls the drive unit so as to adjust the pressing force of the guide unit against the guide rail to a total pressing force of a pressing force that is derived based on the acceleration in the lateral direction of the elevator car extracted from the storage unit and a force that is derived from the acceleration measured by the acceleration measuring unit, in response to the detection of the position of the elevator car by the position detecting unit.

An elevator car rolling suppression method according to the present invention includes: detecting a position of an elevator car in the vertical direction within a shaft provided in a building by a position detecting unit, the elevator car being provided to be elevatable within the shaft; extracting, from a storage unit that has stored in advance the position of the elevator car in the vertical direction within the shaft and an acceleration in the lateral direction of the elevator car at the stored position of the elevator car in association with each other, the acceleration in the lateral direction of the elevator car stored in association with the stored position of the elevator car corresponding to the position of the elevator car detected by the position detecting unit; and controlling a drive unit so as to adjust a pressing force, against a guide rail, of a guide unit that is provided to be movable along the guide rail extending in the vertical direction along the shaft and that restricts movement of the elevator car in the lateral direction orthogonal to the vertical direction to a pressing force that is derived based on at least the acceleration in the lateral direction of the elevator car extracted from the storage unit, in response to the detection of the position of the elevator car by the position detecting unit.

DETAILED DESCRIPTION OF THE PREFERRED EMBODIMENTS

Hereinafter, a first embodiment of the present invention will be described with reference to the drawings.

Figure 1:
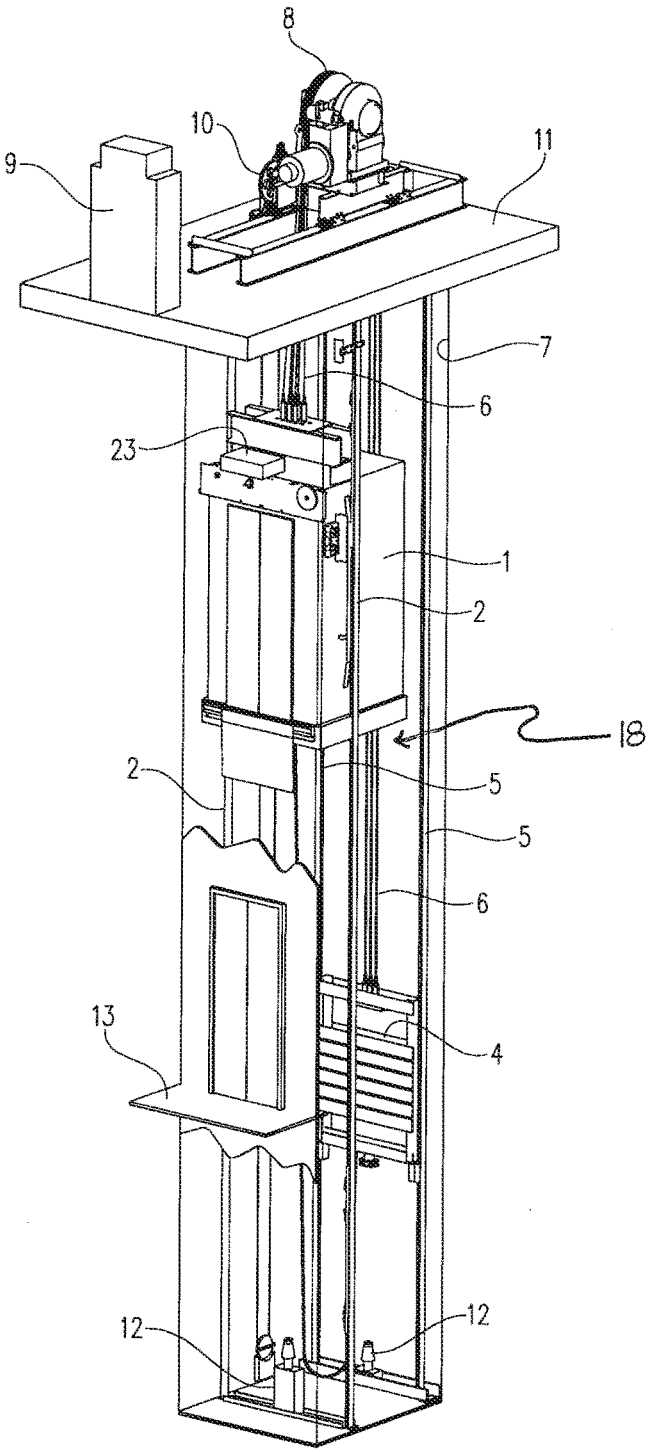
FIG. 1 is a perspective view showing an overall configuration of an elevator provided with a car rolling suppression device according to a first embodiment of the present invention.

As shown in FIG. 1, an elevator according to this embodiment includes: an elevator car 1 provided to be elevatable within a shaft 7 provided in a building; a guide rail (hereinafter, referred to as a car guide rail) 2 fixed to the building and extending in the vertical direction along the shaft 7; and a guide unit 3 provided to be movable along the car guide rail 2 and configured to restrict movement of the elevator car 1 in the lateral direction orthogonal to the vertical direction (see FIG. 2). The elevator further includes a balance weight (so-called counter weight) 4, a weight guide rail 5 configured to guide the balance weight 4, and a rope 6 coupling the elevator car 1 and the balance weight 4 to each other.

The elevator further includes a hoisting machine 8, a control panel 9 for controlling the hoisting machine 8, and a speed controller 10 for controlling the speed of the elevator. These members are arranged within a machine room 11 provided on the rooftop of the building. The elevator further includes a shock absorber 12 provided in the lower part of the shaft 7, a car control device 23 configured to control the opening and closing of the door of the elevator car 1, and the like. The elevator further includes a car rolling suppression device 18 configured to suppress rolling of the elevator car 1.

In this embodiment, the car guide rail 2 is arranged on each of both sides in the lateral direction of the elevator car 1. That is, the elevator includes a pair of car guide rails 2. Each of the car guide rails 2 is constituted by joining a plurality of rail members in line in the vertical direction. Each of the rail members is composed of an elongated steel material with the same sectional shape and the same size. In this embodiment, a T-shaped steel having a T-shaped cross section is employed as the rail member.

Figure 3:
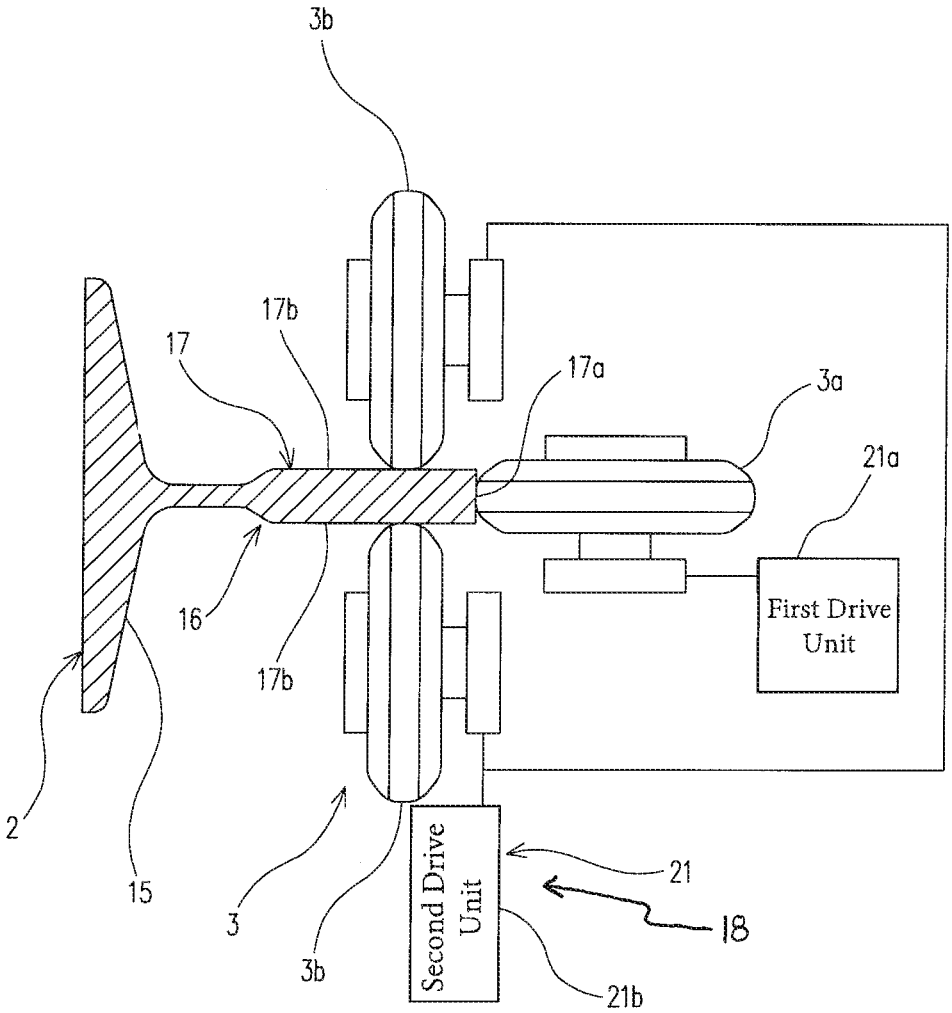
FIG. 3 is a sectional view taken along the line III-III as seen in the direction of the arrows in FIG. 2.

Accordingly, the sectional shape in a direction orthogonal to the vertical direction (sectional shape as seen in the vertical direction) of the car guide rail 2 is T-shaped as shown in FIG. 3. That is, the car guide rail 2 includes a base 15 having a certain width, and a projection 16 projecting in a direction intersecting the width direction of the base 15.

The base 15 is supported by the wall or the like of the building. The projection 16 is in the form of a strip plate extending in the vertical direction and has one end face in the width direction orthogonal to the longitudinal direction connected to the base 15. Accordingly, the outer surface of the projection 16 constitutes a guide surface 17 configured to guide the guide unit 3. In this embodiment, the projection 16 has three guide surfaces 17 (17*a* and 17*b*). Specifically, the car guide rail 2 has a first guide surface 17*a* whose surface is opposed to the elevator car 1 and a pair of second guide surfaces 17*b* orthogonal to the first guide surface 17*a*, as the guide surfaces 17. The first guide surface 17*a* is the other end face in the width direction of the projection 16, and the pair of second guide surfaces 17*b* are both sides in the thickness direction of the projection 16.

Figure 2:
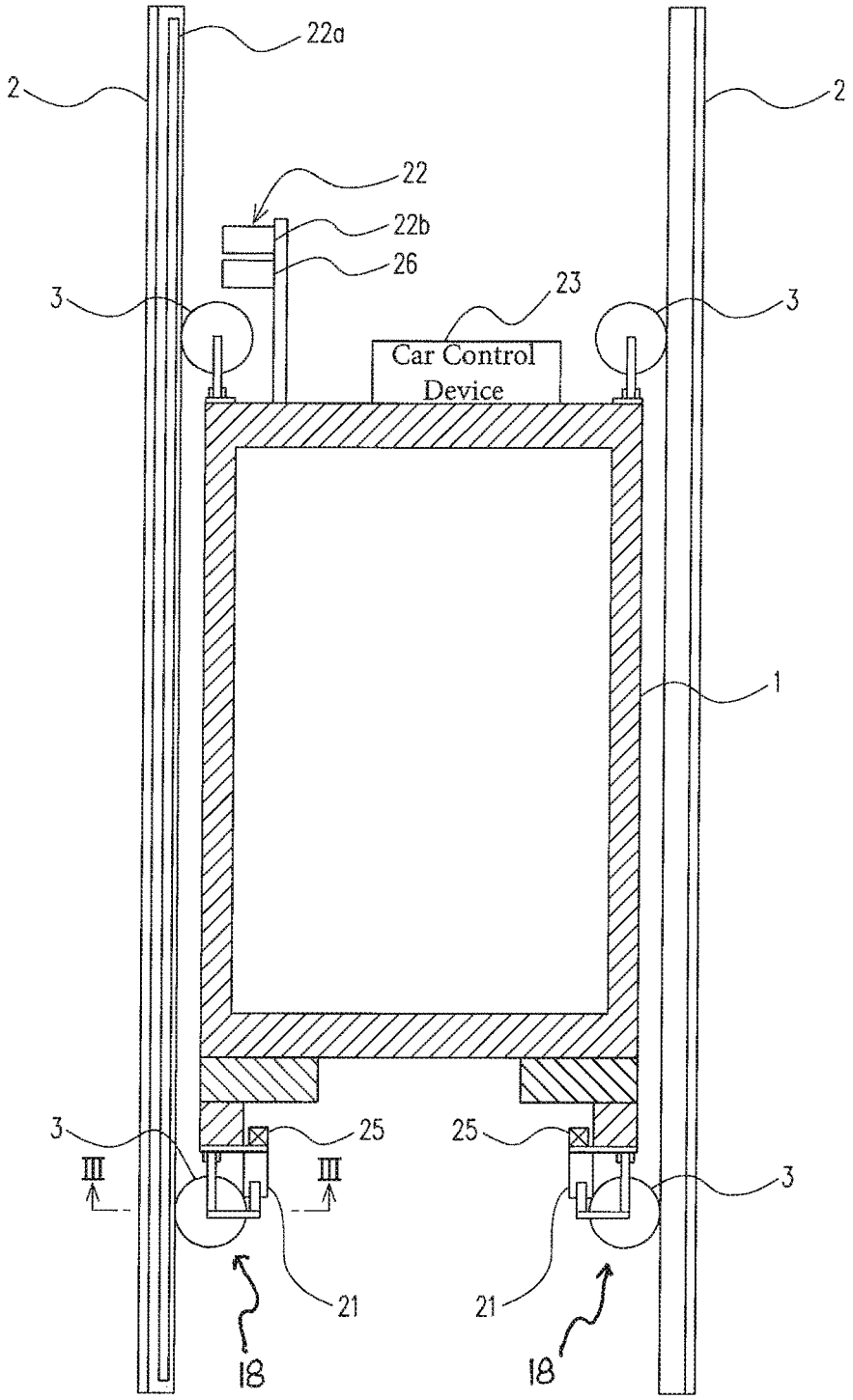
FIG. 2 is an enlarged sectional view in the periphery of an elevator car including the car rolling suppression device according to the aforementioned embodiment.

As shown in FIG. 2, the guide unit 3 is provided corresponding to each of the pair of car guide rails 2 arranged on both sides of the elevator car 1. In this embodiment, the guide unit 3 is a roller guide having a wheel and an axle configured to rotatably support the wheel. Further, the guide unit 3 is provided on each of the upper side and the lower side of the elevator car 1. As shown in FIG. 3, the guide unit 3 is provided for each of the plurality of guide surfaces 17 of the car guide rails 2. Specifically, a first guide unit 3*a* provided corresponding to the first guide surface 17*a* and a pair of second guide units 3*b* provided corresponding respectively to the pair of second guide surfaces 17*b* are provided as the guide unit 3. The pair of second guide units 3*b* are axisymmetrically arranged with the projection 16 interposed therebetween.

Returning to FIG. 1, the rope 6 coupling the elevator car 1 and the balance weight 4 to each other is wound around the hoisting machine 8. Thus, the hoisting machine 8 moves the rope 6 by being driven, so as to move up and down the elevator car 1 along the car guide rail 2 and move up and down the balance weight 4 along the weight guide rail 5. The elevator car 1 is coupled to one end of the rope 6, and the balance weight 4 is coupled to the other end of the rope 6. Accordingly, when the hoisting machine 8 is driven, the elevator car 1 and the balance weight 4 move up and down in the opposite traveling directions to each other. This can reduce the load of the hoisting machine 8 and can allow the elevator car 1 to move up and down with small power. The speed controller 10 stops the elevator car 1 when the elevation speed of the elevator car 1 reaches or exceeds a specified value. The shock absorber 12 mitigates the impact when it comes into contact with the elevator car 1.

Figure 4:
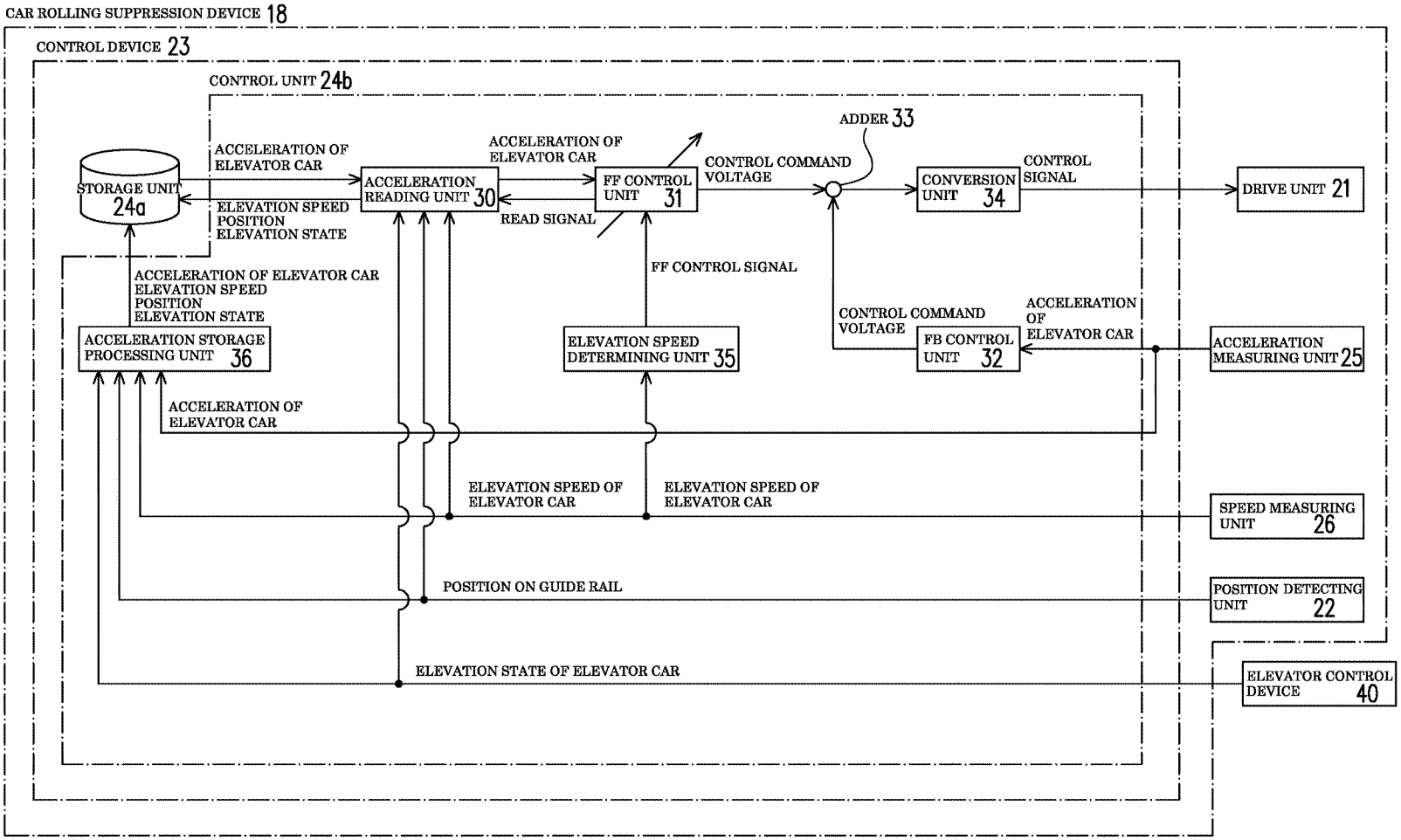
FIG. 4 is a block diagram of the car rolling suppression device according to the aforementioned embodiment.

As shown in FIG. 4, the car rolling suppression device 18 includes: a drive unit 21 attached to the elevator car 1 and configured to press the guide unit (roller guide) 3 against the car guide rail 2; a position detecting unit 22 configured to detect a position of the elevator car 1 in the vertical direction within the shaft 7; a storage unit 24*a* that has stored in advance the position of the elevator car 1 in the vertical direction within the shaft 7 and an acceleration in the lateral direction of the elevator car 1 at the position of the elevator car 1 in association with each other; and a control unit 24*b* configured to extract, based on the position of the elevator car 1 detected by the position detecting unit 22, the acceleration in the lateral direction of the elevator car 1 stored in association with the stored position of the elevator car 1 corresponding to the position of the elevator car 1 where the elevator car 1 is about to pass from the storage unit 24*a*, and to control the drive unit 21 so as to adjust the pressing force of the guide unit 3 against the car guide rail 2 to a pressing force that is derived based on at least the extracted acceleration in the lateral direction of the elevator car 1, in response to the detection of the position of the elevator car 1 by the position detecting unit 22. Herein, the position of the elevator car 1 where the elevator car 1 is about to pass means a passing position of the elevator car 1 in each elevation starting from a departure floor to a destination floor.

The car rolling suppression device 18 further includes an acceleration measuring unit 25 configured to measure the acceleration of the elevator car 1 in the lateral direction orthogonal to the vertical direction. The car rolling suppression device 18 further includes a speed measuring unit 26 configured to measure the elevation speed of the elevator car 1.

As shown in FIG. 2, the drive unit 21 according to this embodiment is provided corresponding to each of the guide units 3 provided on the lower side of the elevator car 1, out of a plurality of guide units 3. In this embodiment, the plurality of guide units 3 are provided corresponding respectively to the plurality of guide surfaces 17 of the car guide rail 2, as shown in FIG. 3, and therefore the drive unit 21 is provided for each of the guide units 3.

That is, the car rolling suppression device 18 according to this embodiment includes a first drive unit 21*a* configured to propel the first guide unit 3*a* toward the car guide rail 2 (the first guide surface 17*a* opposed to the first guide unit 3*a*), and a second drive unit 21*b* configured to respectively propel the pair of second guide units 3*b* toward the car guide rail 2 (the second guide surfaces 17*b* opposed to the second guide units 3*b*), as the drive unit 21.

In this embodiment, the car guide rail 2 is provided on each of both sides of the elevator car 1, and therefore the drive units 21 each having the first drive unit 21*a* and the second drive unit 21*b* are provided corresponding respectively to the pair of car guide rails 2, as shown in FIG. 2.

Each drive unit 21 is an actuator configured to reciprocally move the guide unit 3. The drive unit 21 gives the guide unit 3 a propulsive force that is derived from the force to move the guide unit 3. That is, as shown in FIG. 3, the drive unit 21 propels the guide unit 3 in a direction orthogonal to the guide surface 17 of the car guide rail 2. Thus, the drive unit 21 presses the guide unit 3 against the guide surface 17 of the car guide rail 2 opposed to the guide unit 3.

In this embodiment, the first drive unit 21*a* and the second drive units 21*b* are provided as the drive unit 21, the first guide surface 17*a* and the second guide surfaces 17*b* are provided as the guide surface 17, and the first guide unit 3*a* and the second guide units 3*b* are provided as the guide unit 3, as described above. Therefore, the first drive unit 21*a* propels the first guide unit 3*a* in a direction orthogonal to the first guide surface 17*a* to press the first guide unit 3*a* against the first guide surface 17*a* opposed to the first guide unit 3*a*. In contrast, the second drive units 21*b* propel the second guide units 3*b* in directions orthogonal to the second guide surfaces 17*b* to press the second guide units 3*b* against the second guide surfaces 17*b* opposed to the second guide units 3*b*.

As shown in FIG. 2, the position detecting unit 22 is constituted by a detection object 22*a* provided in the elevation range of the elevator car 1 and having information on the position (height) in the vertical direction within the shaft 7, and a detection unit 22*b* configured to obtain the information of the detection object 22*a* (the information on the position).

In this embodiment, the position detecting unit 22 is provided corresponding to one of the pair of guide rails 2.

Specifically, the detection object 22*a* is attached to one of the guide rails 2. The detection object 22*a* is installed herein from the uppermost part to the lowermost part of the shaft 7. That is, the detection object 22*a* is arranged extending from the lowest floor to the top floor. The detection object 22*a* is an elongated tape on which a plurality of two-dimensional barcodes having the information on the position (height) in the vertical direction within the shaft 7 are printed at intervals in the longitudinal direction.

The detection unit 22*b* is attached to the elevator car 1. The detection unit 22*b* is arranged at a position so as to be capable of detecting the detection object 22*a* attached to one of the guide rails 2. In this embodiment, the detection unit 22*b* has an image recognition function to read the two-dimensional barcodes of the detection object 22*a*. The detection unit 22*b* obtains the information on the position in the vertical direction within the shaft 7 from the two-dimensional barcodes of the detection object 22*a* by reading the two-dimensional barcodes.

As shown in FIG. 4, the position detecting unit 22 (the detection unit 22*b*) is configured to be capable of outputting the obtained information to the outside such as the control unit 24*b*. That is, the position detecting unit 22 (the detection unit 22*b*) outputs the information on the position in the vertical direction within the shaft 7 to the outside. In this way, the position detecting unit 22 detects the position (height) of the elevator car 1 in the vertical direction within the shaft 7 by sensing the detection object 22*a* using the detection unit 22*b*.

The storage unit 24*a* is a storage device capable of rewriting or writing information, and examples thereof to be employed include a RAM, a ROM, an external memory, and a hard disk device.

As described above, the storage unit 24*a* stores the position of the elevator car 1 in the vertical direction within the shaft 7 and the acceleration in the lateral direction of the elevator car 1 at the stored position of the elevator car 1 in association with each other. In the following description, the acceleration in the lateral direction of the elevator car 1 is simply referred to as the acceleration of the elevator car 1 by omitting the specification expressed as "in the lateral direction", but "the acceleration of the elevator car 1" still means the acceleration in the lateral direction orthogonal to the vertical direction.

Information to be stored in the storage unit 24*a* will be described herein. The position of the elevator car 1 in the vertical direction within the shaft 7 means each of a plurality of positions set at specific intervals in the vertical direction within the elevation range of the elevator car 1. That is, the position of the elevator car 1 in the vertical direction within the shaft 7 means each of a plurality of positions having different distances in the vertical direction from the reference position (for example, the position of the lowermost part). In the position detecting unit 22 of this embodiment, the detection unit 22*b* is configured to detect each of the plurality of two-dimensional barcodes provided on the detection object 22*a*, and therefore the positions of the elevator car 1 (the plurality of positions) stored in the storage unit 24*a* coincide with the positions of the plurality of two-dimensional barcodes of the detection object 22*a*.

The acceleration of the elevator car 1 stored in the storage unit 24*a* is obtained in advance by actual measurement using the acceleration measuring unit 25, and is an acceleration of components in the lateral direction (the horizontal direction) while the elevator car 1 moves up and down between the lowest floor and the top floor. That is, the acceleration of the elevator car 1 stored in the storage unit 24*a* means the acceleration of the elevator car 1 measured in advance at each of the plurality of positions in the vertical direction within the shaft 7.

Accordingly, the storage unit 24*a* stores the acceleration of the elevator car 1 corresponding each of the plurality of positions of the elevator car 1 that have been set, in the state where the acceleration of the elevator car 1 is associated therewith.

In this embodiment, an acceleration in a first direction orthogonal to the vertical direction in which the car guide rail 2 extends and an acceleration in a second direction orthogonal to the vertical direction and the first direction are stored in the storage unit 24*a* as the acceleration of the elevator car 1. That is, as the acceleration of the elevator car 1 (the acceleration of the elevator car 1 stored in the storage unit 24*a*), the acceleration of the elevator car 1 used for controlling the first drive unit 21*a* (the acceleration of the elevator car 1 in a direction orthogonal to the guide surface 17*a* against which the first guide unit 3*a* is pressed) and the acceleration of the elevator car 1 used for controlling the second drive units 21*b* (the acceleration of the elevator car 1 in a direction orthogonal to the guide surfaces 17*b* against which the second guide units 3*b* are pressed) are stored in the storage unit 24*a*.

Further, as the acceleration of the elevator car 1 at each position (the acceleration of the elevator car 1 stored in the storage unit 24*a*), the acceleration generated when the elevator car 1 moves up from the lowest floor side to the top floor side and the acceleration generated when the elevator car 1 moves down from the top floor side to the lowest floor side are stored in the storage unit 24*a*.

The control unit 24*b* controls the drive units 21 to extract, based on the position of the elevator car 1 detected by the position detecting unit 22, the acceleration of the elevator car 1 stored in association with the stored position of the elevator car 1 corresponding to the position of the elevator car 1 where the elevator car 1 is about to pass from the storage unit 24*a*, and to adjust the pressing force of the guide units 3 against the car guide rails 2 to a pressing force that is derived based on at least the extracted acceleration of the elevator car 1, in response to the detection of the position of the elevator car 1 by the position detecting unit 22. That is, the control unit 24*b* is configured to perform feedforward control on the drive units 21 (the pressing force of the guide units 3 against the car guide rails 2). The pressing force that is derived based on the acceleration of the elevator car 1 is a total force of a force that is derived directly from the acceleration of the elevator car 1 and a specific pressing force (a pressing force that is constantly applied to the car guide rails 2 by the guide units 3 (force of 0 or more)).

Further, the control unit 24*b* of this embodiment controls the drive units 21 so as to adjust the pressing force of the guide units 3 against the car guide rails 2 to a total pressing force of a pressing force that is derived based on the extracted acceleration of the elevator car 1 and a force that is derived from the acceleration measured by the acceleration measuring units 25, in response to the detection of the position of the elevator car 1 by the position detecting unit 22. That is, the control unit 24*b* also performs feedback control on the drive units 21 (the pressing force of the guide units 3 against the car guide rails 2).

In this embodiment, the control unit 24*b* has two types of control patterns of the drive units 21, including a first control pattern in which only the above-described feedback control is performed, and a second control pattern in which the above-described feedback control is combined with the above-described feedforward control.

The control unit 24*b* is specifically described herein. As shown in FIG. 4, the control unit 24*b* includes: an acceleration reading unit 30 configured to extract the acceleration of the elevator car 1 from the storage unit 24*a* based on the detection result by the position detecting unit 22; and a FF control unit 31 configured to convert a propulsion amount (movement amount) of the guide units 3 that allows the force, which is derived based on the acceleration of the elevator car 1 extracted by the acceleration reading unit 30, to be equal to the propulsive force of the guide units 3 obtained by driving the drive units 21, into a control command voltage.

The control unit 24*b* further includes a FB control unit 32 configured to convert a propulsion amount (movement amount) of the guide units 3 that allows the force, which is derived from the acceleration of the elevator car 1 measured by the acceleration measuring units 25, to be equal to the propulsive force of the guide units 3 obtained by driving the drive units 21, into a control command voltage, and an adder 33 configured to add the control command voltage that is output from the FB control unit 32 to the control command voltage that is output from the FF control unit 31.

The control unit 24*b* further includes a conversion unit 34 configured to convert the control command voltage (control command voltage corresponding to the propulsion amount of the guide units 3) from the adder 33 into a control signal that causes the drive units 21 to propel the guide units 3 with a propulsion amount corresponding to the control command voltage. The control unit 24*b* further includes an elevation speed determining unit 35 configured to determine whether or not the elevation speed of the elevator car 1 is equal to or higher than a specific speed. The control unit 24*b* further includes an acceleration storage processing unit 36 configured to allow the storage unit 24*a* to store the acceleration of the elevator car 1 in association with the stored position of the elevator car 1 in the vertical direction within the shaft 7.

The conversion unit 34 includes a signal conversion storage unit (not shown) configured to store the control command voltage (control command voltage corresponding to the propulsion amount of the guide units 3) from the adder 33 and the control signal that causes the drive units 21 to propel the guide units 3 with a propulsion amount corresponding to the control command voltage, in association with each other.

The conversion unit 34 extracts the control command voltage from the FF control unit 31 via the adder 33 or the control signal corresponding to the control command voltage as the addition result of the FF control unit 31 and the FB control unit 32 via the adder 33 from the signal conversion storage unit and outputs it to the drive units 21. The drive units 21 propel the guide units 3 with a propulsion amount so as to exert a specific propulsive force, based on the control signal from the conversion unit 34.

The elevation speed determining unit 35 determines to control the drive units 21 with the second control pattern when the elevation speed of the elevator car 1 is equal to or higher than a specific speed, whereas it determines to control the drive units 21 with the first control pattern when the elevation speed of the elevator car 1 is less than the specific speed. That is, the control unit 24*b* stores the specific speed as a threshold to determine the control pattern of the drive units 21.

As a result of comparison of the elevation speed of the elevator car 1 with the threshold, the elevation speed determining unit 35 outputs a signal (FF control signal) to start a feedforward control to the FF control unit 31 when the elevation speed of the elevator car 1 is determined to be equal to or higher than the specific speed, and stops outputting the FF control signal to stop the feedforward control of the FF control unit 31 when the elevation speed of the elevator car 1 is determined to be less than the specific speed.

The acceleration storage processing unit 36 is configured to rewrite the acceleration of the elevator car 1 stored in the storage unit 24*a* in association with the position of the elevator car 1 in the vertical direction corresponding to the position of the elevator car 1 in the vertical direction within the shaft 7 detected by the position detecting unit 22, with the acceleration of the elevator car 1 detected by the acceleration measuring units 25.

The acceleration storage processing unit 36 according to this embodiment is connected to an elevator control device 40 that controls the elevation of the elevator car 1, and obtains information on the elevation state (upward and downward) of the elevator car 1 from the elevator control device 40. Further, the acceleration storage processing unit 36 obtains the position of the elevator car 1 in the vertical direction within the shaft 7 detected by the position detecting unit 22, the elevation speed of the elevator car 1 obtained by the speed measuring unit 26, and the acceleration of the elevator car 1 obtained by the acceleration measuring units 25, in addition to the information on the elevation state of the elevator car 1.

Then, the acceleration storage processing unit 36 stores the acceleration of the elevator car 1 associated with the position of the elevator car 1 in the vertical direction within the shaft 7, and the elevation state and the elevation speed of the elevator car 1, in the storage unit 24*a*. In the case where the acceleration of the elevator car 1 to be stored in association with the position of the elevator car 1 in the vertical direction within the shaft 7, and the elevation state and the elevation speed of the elevator car 1 has been already stored in the storage unit 24*a*, the acceleration storage processing unit 36 rewrites the acceleration of the elevator car 1 stored in the storage unit 24*a* in association with the position of the elevator car 1 in the vertical direction within the shaft 7, and the elevation state and the elevation speed of the elevator car 1, with the acceleration of the elevator car 1 detected by the acceleration measuring units 25.

The acceleration storage processing unit 36 stores the acceleration measured by the acceleration measuring units 25 in the storage unit 24*a* when rolling of the elevator car 1 is occurring.

Specifically, the acceleration storage processing unit 36 stores the acceleration of the elevator car 1 during test operation before normal operation in the storage unit 24*a* which is measured by the acceleration measuring units 25, in order to obtain the acceleration of the elevator car 1. Accordingly, the control unit 24*b* controls the drive units 21 not to drive during test operation so that the acceleration measuring units 25 can measure the acceleration of the elevator car 1 in the state where rolling of the elevator car 1 is not restricted, and the elevator control device 40 (the elevator control device 40 that controls the elevation of the elevator car 1) connected to the control unit 24*b* moves up and down the elevator car 1 without users or luggage being loaded. Into the control unit 24*b*, information indicating that the elevator car 1 is moving up and information indicating that the elevator car 1 is moving down are input from the elevator control device 40.

The storage unit 24*a* and the control unit 24*b* with the above-described configurations are provided for controlling the drive units 21 attached to the elevator car 1 and thus are attached to the elevator car 1 together with the drive units 21. In this embodiment, the storage unit 24*a* and the control unit 24*b* are arranged within the car control device 23 attached to the upper part of the elevator car 1 (see FIG. 2).

The acceleration measuring units 25 measure the acceleration of the elevator car 1 (horizontal acceleration) generated due to rolling of the elevator car 1 (vibration in the lateral direction). In this embodiment, each acceleration measuring unit 25 is an acceleration sensor. The acceleration measuring unit 25 measures the acceleration of the elevator car 1 in a direction orthogonal to the first guide surface 17*a* against which the first guide unit 3*a* is pressed, and the acceleration of the elevator car 1 in a direction orthogonal to the second guide surfaces 17*b* against which the second guide units 3*b* are pressed, as the acceleration of the elevator car 1 during elevation.

A pair of acceleration measuring units 25 are provided corresponding respectively to the pair of guide rails 2. The acceleration measured by each of the pair of acceleration measuring units 25 serves as the acceleration at the position of the elevator car 1 in the vertical direction within the shaft 7 (at each of the plurality of points) which is detected by the position detecting unit 22.

The speed measuring unit 26 is an encoder attached to the hoisting machine 8 and measures the elevation speed of the elevator car 1 from the moving speed of the rope 6. The speed measuring unit 26 is configured to be capable of outputting the elevation speed of the elevator car 1 to the elevation speed determining unit 35, the acceleration reading unit 30, or the like.

Next, a car rolling suppression method (elevator car rolling suppression method) using the car rolling suppression device 18 with the above-described configuration will be described in detail with reference to FIG. 4 and FIG. 5.

The car rolling suppression method (elevator car rolling suppression method) using the car rolling suppression device 18 with the above-described configuration includes: a car position detecting step of detecting the position of the elevator car 1 in the vertical direction within the shaft 7 using the position detecting unit 22; an acceleration extracting step of extracting the acceleration of the elevator car 1 corresponding to the position of the elevator car 1 detected by the car position detecting step from the storage unit 24*a* that has stored in advance the position of the elevator car 1 in the vertical direction within the shaft 7 and the acceleration of the elevator car 1 at the position of the elevator car 1 in association with each other; a controlling step of controlling the drive unit 21 so as to adjust the pressing force of the guide unit 3 against the car guide rail 2 to a pressing force that is derived based on at least the acceleration of the elevator car 1 extracted by the acceleration extracting step, in response to the detection of the position of the elevator car 1 by the position detecting unit 22.

A specific description will be given. The elevator performs test operation of moving up and down the elevator car 1 in order to measure the acceleration of the elevator car 1, and normal operation of moving up and down the elevator car 1 while rolling of the elevator car 1 is suppressed by controlling the drive units 21 based on the acceleration of the elevator car 1 measured during the test operation.

In the test operation, when the elevator car 1 starts elevation, that is, moving up or down, the acceleration storage processing unit 36 of the control unit 24*b* obtains the elevation state of the elevator car 1 from the elevator control device 40, as shown in FIG. 4. Then, the position detecting unit 22 starts detecting the position of the elevator car 1 in the vertical direction within the shaft 7. The speed measuring unit 26 starts measuring the elevation speed of the elevator car 1. The acceleration measuring units 25 start measuring the acceleration of the elevator car 1.

The acceleration storage processing unit 36 obtains the elevation state of the elevator car 1 obtained from the elevator control device 40, the detection result of the position of the elevator car 1 in the vertical direction within the shaft 7 by the position detecting unit 22, the measurement result of the elevation speed of the elevator car 1 by the speed measuring unit 26, and the measurement result of the acceleration of the elevator car 1 by the acceleration measuring units 25, and stores them in the storage unit 24*a*. The storage unit 24*a* stores the position of the elevator car 1 in the vertical direction within the shaft 7, the elevation state of the elevator car 1, the elevation speed of the elevator car 1, and the acceleration of the elevator car 1, in association with each other. Then, the measurement of the acceleration of the elevator car 1 is repeated until the elevator car 1 stops.

Meanwhile, in the normal operation, the position detecting unit 22 starts detecting the position of the elevator car 1 in the vertical direction within the shaft 7 when the elevator car 1 starts elevation, that is, moving up or down. The speed measuring unit 26 starts measuring the elevation speed of the elevator car 1. Then, upon detecting the position of the elevator car 1 in the vertical direction within the shaft 7, the position detecting unit 22 simultaneously transmits the measurement result of the position of the elevator car 1 in the vertical direction within the shaft 7 to the acceleration reading unit 30 of the control unit 24*b*.

Figure 5:
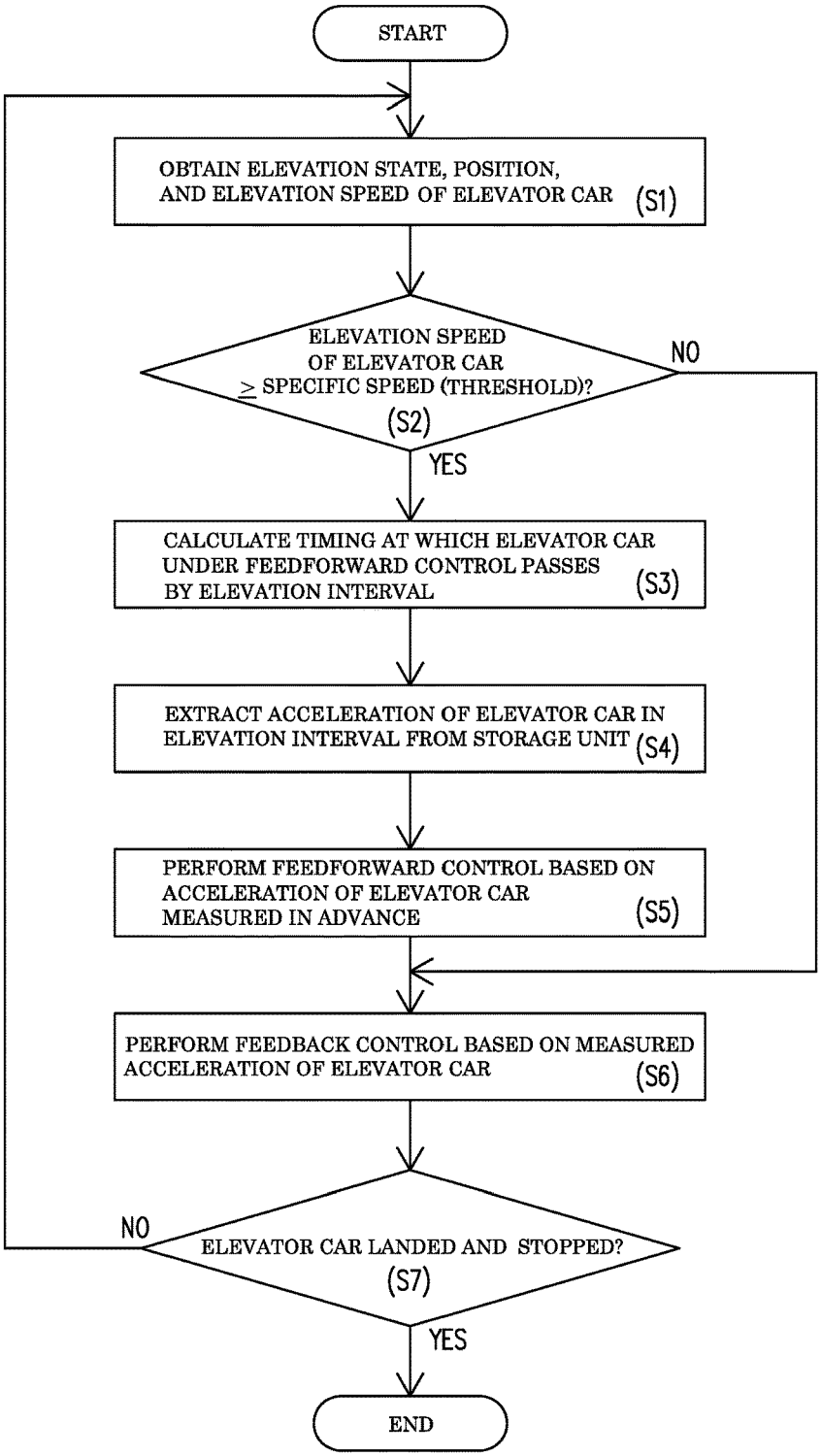
FIG. 5 is a control flowchart of a control unit of the car rolling suppression device according to the aforementioned embodiment.

As shown in FIG. 4 and FIG. 5, when the control unit 24*b* obtains the elevation state of the elevator car 1 from the elevator control device 40, and obtains the position of the elevator car 1 in the vertical direction within the shaft 7 and the elevation speed of the elevator car 1 based on the detection result by the position detecting unit 22 (step S1), the elevation speed determining unit 35 determines whether the elevation speed of the elevator car 1 is equal to or higher than a specific speed (threshold) (step S2). In the case where the elevation speed of the elevator car 1 is less than the specific speed (threshold) (NO in step S2), the elevation speed determining unit 35 does not transmit a FF control signal to the FF control unit 31. Therefore, the first control pattern is selected as the control pattern of the drive units 21. That is, the elevation speed determining unit 35 does not operate the FF control unit 31, and the control unit 24*b* suppresses rolling of the elevator car 1 only by the FB control unit 32 (step S6).

In the case where the elevation speed of the elevator car 1 is equal to or higher than the specific speed (threshold) (YES in step S2), the elevation speed determining unit 35 transmits a FF control signal to the FF control unit 31. Therefore, the second control pattern is selected as the control pattern of the drive units 21. That is, the elevation speed determining unit 35 operates the FF control unit 31. The elevation speed determining unit 35 calculates a timing at which the elevator car 1 under feedforward control passes by an elevation interval (step S3). The elevation speed determining unit 35 outputs the read signal to the acceleration reading unit 30 at a timing when the acceleration of the elevator car 1 is read out.

The acceleration reading unit 30 extracts the acceleration of the elevator car 1 from the storage unit 24*a*, and inputs it into the FF control unit 31 (step S4). The FF control unit 31 calculates a propulsion amount of the guide units 3 that allows a pressing force, which is derived based on the acceleration of the elevator car 1 stored in the storage unit 24*a*, to be equal to a propulsive force, and converts the propulsion amount of the guide units 3 into a control command voltage (step S5).

Meanwhile, the FB control unit 32 calculates a propulsion amount of the guide units 3 that allows the force, which is derived from the acceleration of the elevator car 1 measured by the acceleration measuring units 25, to be equal to the propulsive force for feedback control based on the measurement result of the acceleration of the elevator car 1 by the acceleration measuring units 25, and converts the propulsion amount into a control command voltage. Then, the adder 33 adds the value of the control command voltage that is output by the FB control unit 32 to the value of the control command voltage that is output by the FF control unit 31. The drive units 21 drive the guide units 3 based on the control command voltage that is output from the adder 33 (step S6).

The control unit 24*b* controls the drive units 21 with the second control pattern until the elevation speed of the elevator car 1 is less than the specific speed (threshold) (NO in step S2). Further, when the elevator car 1 lands and stops (YES in step S7), the control unit 24*b* ends the control of the drive units 21.

As described above, the control unit 24*b* extracts in advance, based on the detection result by the position detecting unit 22 and the information stored in the storage unit 24*a*, the acceleration of the elevator car 1 stored in association with the stored position of the elevator car 1 corresponding to the position in the vertical direction within the shaft 7 where the elevator car 1, which is moving up or down within the shaft 7, is about to pass before the position where the elevator car 1 is about to pass is reached, and controls the drive units 21 at the timing at which the elevator car 1 reaches the position where the elevator car 1 is about to pass.

Accordingly, the guide units 3 whose pressing force against the car guide rails 2 is adjusted by the drive units 21 exert a pressing force corresponding to the actual position of the elevator car 1 against the car guide rails 2. As a result, the force in the lateral direction due to the rolling of the elevator car 1 during elevation counteracts a part or the whole of the reaction force of the pressing force of the guide units 3 against the car guide rails 2 (at least the reaction force of the pressing force that is derived from the acceleration of the elevator car 1), so that the rolling of the elevator car 1 is practically restricted.

Although the pressing force of the guide units 3 against the car guide rails 2 is not particularly mentioned, the reaction force of the pressing force derived directly from the acceleration due to the rolling of the elevator car 1 and the force caused by the rolling of the elevator car 1 are opposite in direction and the same in magnitude, and thus completely counteract each other. Therefore, in the case where the pressing force that is derived based on the acceleration of the elevator car 1 is obtained by adding a specific pressing force to the pressing force derived directly from the acceleration of the elevator car 1, the guide units 3 are pressed against the car guide rails 2 constantly with the specific pressing force (a set pressing force).

Accordingly, in the case where the guide units 3 are maintained in pressure contact with the car guide rails 2, the pressing force that is derived based on the acceleration of the elevator car 1 may be obtained by adding a specific pressing force (value larger than 0) to the pressing force derived directly from the acceleration of the elevator car 1. Meanwhile, in the case where the guide units 3 are merely maintained in contact with the car guide rails 2 (there is no need to apply pressure), the pressing force that is derived based on the acceleration of the elevator car 1 may be obtained by adding a specific pressing force (0) to the pressing force derived directly from the acceleration of the elevator car 1.

Further, the control unit 24*b* controls the drive units 21 to suppress the rolling of the elevator car 1 when the elevation speed of the elevator car 1 is a specific speed. Generally, a user feels rolling of the elevator car 1 more at a high elevation speed of the elevator car 1 than at a low elevation speed of the elevator car 1. As a result, even when the elevation speed of the elevator car 1 is the specific speed that makes the user feel uncomfortable, the uncomfortable feeling of the user can be suppressed to the minimum.

Further, the control unit 24*b* rewrites the acceleration of the elevator car 1 stored in the storage unit 24*a* with the acceleration of the elevator car 1 measured by the acceleration measuring units 25, and therefore the acceleration of the elevator car 1 stored in the storage unit 24*a* fits the actual rolling of the elevator car 1. Accordingly, even if the form of rolling of the elevator car 1 changes due to the deterioration with age, the use state, or the like of each device constituting the elevator, the control unit 24*b* extracts the acceleration of the elevator car 1 that fits the actual rolling of the elevator car 1 and controls the drive units 21 based thereon. Thus, the rolling of the elevator car 1 is practically restricted.

The car rolling suppression device 18 according to this embodiment can reliably restrict rolling of the elevator car 1, even if the form of the rolling of the elevator car 1 changes due to the deterioration with age, the use state, or the like of each device constituting the elevator.

Specifically, the control unit 24*b* controls the drive units 21 so as to adjust the pressing force of the guide units 3 against the car guide rails 2 to a pressing force that is derived based on the acceleration of the elevator car 1 that is stored in the storage unit 24*a* in association with the stored position in the vertical direction corresponding to the position of the elevator car 1 detected by the position detecting unit 22.

In this state, the drive units 21 are controlled based on the information stored in the storage unit 24*a*, and therefore if the form of the rolling of the elevator car 1 does not change from the time when the information has been stored in the storage unit 24*a*, the car rolling suppression device 18 prevents the elevator car 1 during elevation from rolling.

However, in an elevator, the form of rolling of the elevator car 1 may sometimes change due to the deterioration with age, the use state, or the like of each device, and thus the acceleration in the lateral direction due to rolling of the elevator car 1 which has been stored in the storage unit 24*a* may be different from the actual acceleration in the lateral direction due to the rolling of the elevator car 1 in some cases. In such a case, the pressing force of the guide units 3 against the car guide rails 2 may be excessive or deficient if the guide units 3 are pressed against the car guide rails 2 with the pressing force that is derived based on the acceleration in the lateral direction due to the rolling of the elevator car 1 which has been stored in the storage unit 24*a*, so that the rolling of the elevator car 1 may fail to be sufficiently restricted.

In the car rolling suppression device 18 according to this embodiment, the acceleration measuring units 25 measure the acceleration of the elevator car 1 while the control unit 24*b* causes the guide units 3 to be pressed against the car guide rails 2 with the pressing force that is derived based on the acceleration of the elevator car 1 stored in the storage unit 24*a*, and therefore the measurement result is equal to the difference between the acceleration in the lateral direction due to the rolling of the elevator car 1 which has been stored in the storage unit 24*a* and the actual acceleration in the lateral direction due to the rolling of the elevator car 1 (varied acceleration).

Accordingly, the control unit 24*b* controls the drive units 21 so as to adjust the pressing force of the guide units 3 against the car guide rails 2 to a total pressing force of the pressing force that is derived based on the extracted acceleration of the elevator car 1 and the force that is derived from the acceleration measured by the acceleration measuring units 25, in response to the detection of the position of the elevator car 1 by the position detecting unit 22, thereby allowing the guide units 3 to be pressed against the car guide rails 2 with a pressing force obtained by taking the change in the form of rolling of the elevator car 1 into account.

That is, the control unit 24*b* controls the drive units 21 by taking the difference between the actual acceleration of the elevator car 1 and the acceleration of the elevator car 1 stored in the storage unit 24*a* into account as a correction value, and therefore the rolling of the elevator car 1 is practically restricted, even if the form of the rolling of the elevator car 1 changes due to the deterioration with age, the use state, or the like.

Next, a second embodiment of the present invention will be described. This embodiment includes the same configurations as the configurations described in the first embodiment. Accordingly, the same or equivalent configurations as the configurations described in the first embodiment are denoted by the same reference numerals as in the first embodiment. Further, descriptions for the same configurations as the configurations described in the first embodiment are not repeated herein by referring to the first embodiment. Only the configurations that are different from the configurations described in the first embodiment will be described herein.

The storage unit 24*a* stores a plurality of elevation patterns of the elevator car 1 in each of which at least one of the departure floor and the destination floor of the elevator car 1 is different and a plurality of elevation speeds of the elevator car 1 at a specific position in the vertical direction within the shaft 7 when the elevator car 1 is moved up and down with the respective elevation patterns. Accordingly, the storage unit 24*a* stores the position of the elevator car 1 in the vertical direction within the shaft 7 and the acceleration of the elevator car 1 at the aforementioned position of the elevator car 1 for each elevation pattern. That is, the storage unit 24*a* stores in advance the position of the elevator car 1 in the vertical direction within the shaft 7 and the acceleration of the elevator car 1 at the aforementioned position of the elevator car 1 in association with each other, as information on each of the plurality of elevation patterns.

Here, the information to be stored in the storage unit 24*a* will be described. The plurality of elevation patterns are movement patterns of the elevator car 1 having different departure floors and destination floors of the elevator car 1. The elevation speeds of the elevator car are moving speeds of the elevator car actually measured in advance at a specific position in the vertical direction within the shaft 7 with the respective plurality of elevation patterns by actually moving up and down the elevator car with the elevation patterns. Each elevation speed of the elevator car is associated with the corresponding elevation pattern.

In this way, in addition that the plurality of elevation patterns are set as the information stored in the storage unit 24*a*, the position of the elevator car 1 and the acceleration of the elevator car 1 are associated with each other as the information corresponding to each elevation pattern in this embodiment. Specifically, the elevator car is actually moved up and down with the plurality of elevation patterns, the acceleration of the elevator car 1 is actually measured in advance at a position of the elevator car 1 in the vertical direction within the shaft 7 with each elevation pattern, and the acceleration of the elevator car 1 obtained by the actual measurement and the position of the elevator car 1 at which the actual measurement of the acceleration is performed are set as information associated with the elevation pattern with which the actual measurement of the acceleration is performed (information stored in the storage unit 24*a*).

The control unit 24*b* extracts the elevation pattern from the storage unit 24*a*, based on the position of the elevator car 1 detected by the position detecting unit 22 and the elevation speed of the elevator car 1 measured by the speed measuring unit 26. Further, the control unit 24*b* extracts, based on the position of the elevator car 1 detected by the position detecting unit 22 and the extracted elevation pattern, the acceleration of the elevator car 1 stored in association with the stored position of the elevator car 1 corresponding to the position of the elevator car 1 detected by the position detecting unit 22 from the storage unit 24*a*, and controls the drive units 21 so as to adjust the pressing force of the guide units 3 against the car guide rails 2 to a pressing force that is derived based on the extracted acceleration of the elevator car 1, in response to the detection of the position of the elevator car 1 by the position detecting unit 22.

In this embodiment, the control unit 24*b* controls the drive units 21 with the second control pattern combining feedback control with feedforward control.

In the first embodiment, the control unit 24*b* includes the elevation speed determining unit 35, whereas the control unit 24*b* according to this embodiment does not include the elevation speed determining unit 35. Therefore, the FF control unit 31 operates based on the acceleration of the elevator car 1 that is output from the acceleration reading unit 30 based on the position of the elevator car 1 in the vertical direction within the shaft 7 and the elevation speed of the elevator car 1, regardless of the presence or absence of a FF control signal from the elevation speed determining unit 35.

Figure 6:
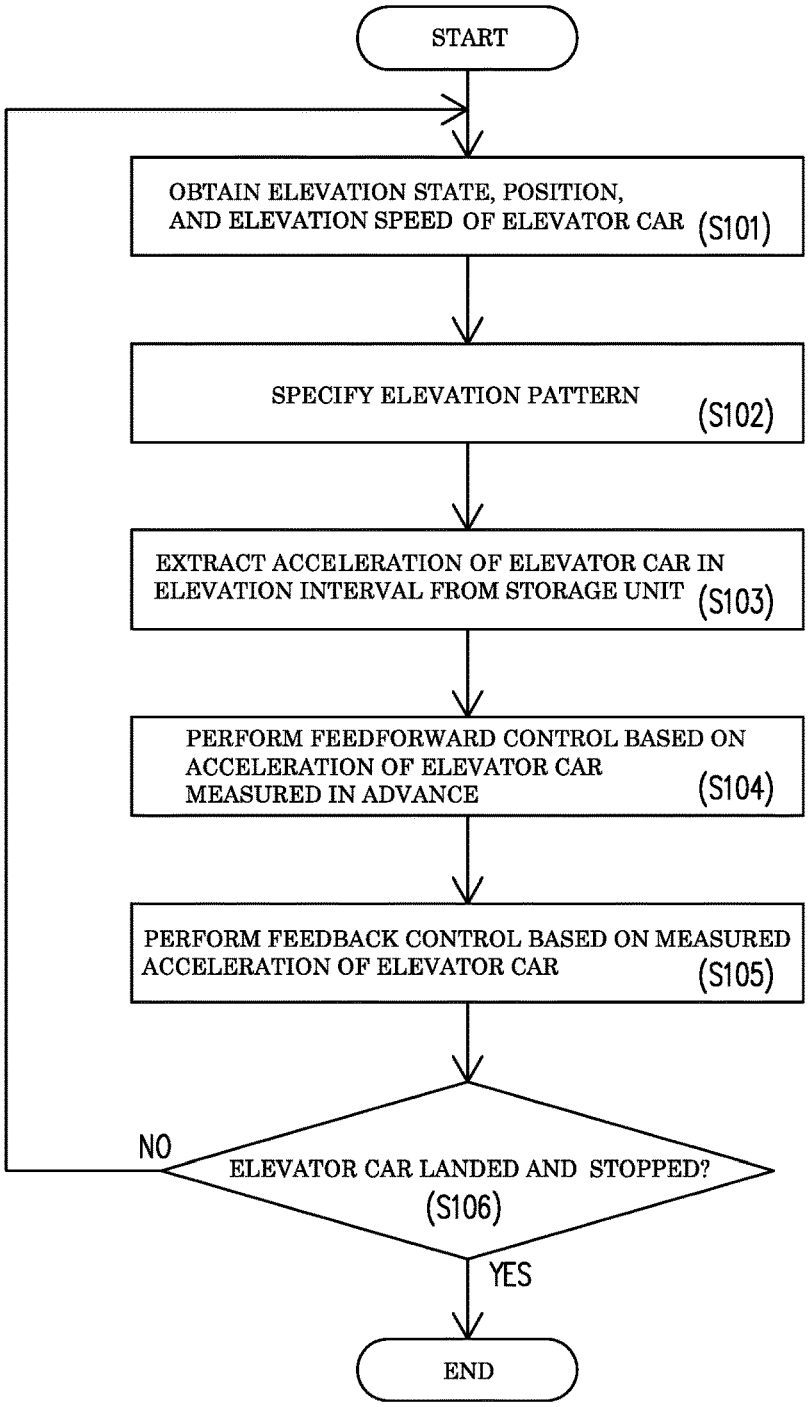
FIG. 6 is a control flowchart of a control unit of a car rolling suppression device according to a second embodiment of the present invention.

Next, a car rolling suppression method (elevator car rolling suppression method) using the car rolling suppression device 18 will be described. As shown in FIG. 6, when the elevator car 1 starts moving up and down, the position detecting unit 22 starts detecting the position of the elevator car 1 in the vertical direction within the shaft 7. The speed measuring unit 26 starts measuring the elevation speed of the elevator car 1. Then, upon detecting the position of the elevator car 1 in the vertical direction within the shaft 7, the position detecting unit 22 simultaneously transmits the measurement result of the position of the elevator car 1 in the vertical direction to the acceleration reading unit 30 of the control unit 24*b*.

When the control unit 24*b* obtains the elevation state of the elevator car 1 from the elevator control device 40, and obtains the position of the elevator car 1 in the vertical direction within the shaft 7 and the elevation speed of the elevator car 1 based on the detection result by the position detecting unit 22 (step S101), the control unit 24*b* specifies an elevation pattern based on the detection result by the position detecting unit 22 and the measurement result by the speed measuring unit 26 (step S102).

The acceleration reading unit 30 extracts the acceleration of the elevator car 1 stored in association with the stored position of the elevator car 1 in the vertical direction within the shaft 7 corresponding to the position of the elevator car 1 in the vertical direction within the shaft 7 in the elevation pattern specified based on the detection result by the position detecting unit 22 and the measurement result by the speed measuring unit 26 from the storage unit 24*a*, and inputs it into the FF control unit 31 (step S103). The FF control unit 31 calculates a propulsion amount of the guide units 3 that allows a pressing force, which is derived based on the acceleration of the elevator car 1 stored in the storage unit 24*a*, to be equal to a propulsive force, and converts the propulsion amount of the guide units 3 into a control command voltage (step S104).

Meanwhile, the FB control unit 32 calculates a propulsion amount of the guide units 3 that allows a force, which is derived from the acceleration of the elevator car 1 measured by the acceleration measuring units 25, to be equal to a propulsive force for feedback control based on the measurement result of the acceleration of the elevator car 1 by the acceleration measuring units 25, and converts the propulsion amount into a control command voltage. Then, the adder 33 adds the value of the control command voltage that is output by the FB control unit 32 to the value of the control command voltage that is output by the FF control unit 31. The drive units 21 drive the guide units 3 based on the control command voltage that is output from the adder 33 (step S105).

The control unit 24*b* controls the drive units 21 with the second control pattern while the elevator car 1 is moving up and down. Further, when the elevator car 1 lands and stops (YES in step S106), the control unit 24*b* ends the control of the drive units 21.

As described above, the car rolling suppression device 18 according to this embodiment can restrict rolling of the elevator car 1 in consideration of the elevation pattern of the elevator car 1.

A specific description will be given. Generally, the departure floor or the destination floor of the elevator car 1 is different depending on the floor on which the user intends to get on or off. Therefore, an elevator has a plurality of elevation patterns with different combinations of the departure floor and the destination floor of the elevator car 1. Each elevation pattern has a different departure floor or destination floor of the elevator car 1 and therefore has a different elevation distance of the elevator car 1. As a result, the plurality of elevation patterns each have a different kinetic state (such as the acceleration state or the constant speed state) of the elevator car 1 during elevation and a different rolling state when the elevator car 1 passes by the same position in the vertical direction within the shaft.

However, the car rolling suppression device 18 according to this embodiment allows the control unit 24*b* to extract (specify) the elevation pattern of the elevator car 1 based on the detection result by the position detecting unit 22, the measurement result by the speed measuring unit 26, and the information stored in the storage unit 24*a*, to further extract in advance the acceleration of the elevator car 1 stored in association with the stored position in the vertical direction within the shaft 7 corresponding to the position where the elevator car 1, which is moving up and down within the shaft 7 with the elevation pattern specified based on the detection result by the position detecting unit 22, the extracted elevation pattern, and the information stored in the storage unit 24*a*, is about to pass before the position where the elevator car 1 is about to pass is reached, and to control the drive units 21 at the timing at which the elevator car 1 reaches the position where the elevator car 1 is about to pass.

Accordingly, the guide units 3 whose pressing force against the car guide rails 2 is adjusted by the drive units 21 exert a pressing force corresponding to the actual elevation pattern of the elevator car 1 and the actual position of the elevator car 1 against the car guide rails 2. As a result, the force in the lateral direction due to rolling of the elevator car 1 during elevation counteracts a part or the whole of the reaction force of the pressing force of the guide units 3 against the car guide rails 2 (at least the reaction force of the pressing force that is derived from the acceleration of the elevator car 1), so that the rolling of the elevator car 1 is practically restricted.

Also in this embodiment, in the case where the guide units 3 are maintained in pressure contact with the car guide rails 2, the pressing force that is derived based on the acceleration of the elevator car 1 may be obtained by adding a specific pressing force (value larger than 0) to the pressing force derived directly from the acceleration of the elevator car 1. Meanwhile, in the case where the guide units 3 are merely maintained in contact with the car guide rails 2 (there is no need to apply pressure), the pressing force that is derived based on the acceleration of the elevator car 1 may be obtained by adding a specific pressing force (0) to the pressing force derived directly from the acceleration of the elevator car 1.

As described above, the car rolling suppression device 18 according to the above-described embodiments includes: drive units 21*a* and 21*b* attached to an elevator car 1 provided to be elevatable within a shaft 7 provided in a building, the drive units 21*a* and 21*b* being configured to press guide units 3*a* and 3*b* that are provided to be movable along guide rails 2 extending in the vertical direction along the shaft 7 and are configured to restrict movement of the elevator car 1 in the lateral direction orthogonal to the vertical direction against the guide rails 2; a position detecting unit 22 configured to detect a position of the elevator car 1 in the vertical direction within the shaft 7; a storage unit 24*a* configured to store in advance the position of the elevator car 1 in the vertical direction within the shaft 7 and an acceleration in the lateral direction of the elevator car 1 at the position of the elevator car 1 in association with each other; and a control unit 24*b* configured to extract, based on the position of the elevator car 1 detected by the position detecting unit 22, the acceleration of the elevator car 1 stored in association with the stored position of the elevator car 1 in the lateral direction corresponding to the position of the elevator car 1, from the storage unit 24*a*, and to control the drive units 21*a* and 21*b* so as to adjust the pressing force of the guide units 3*a* and 3*b* against the guide rails 2 to a pressing force that is derived based on at least the extracted acceleration in the lateral direction of the elevator car 1, in response to the detection of the position of the elevator car 1 by the position detecting unit 22.

Accordingly, in the car rolling suppression device 18 according to the above-described embodiments, the storage unit 24*a* stores in advance the position of the elevator car 1 in the vertical direction within the shaft 7 and the acceleration in the lateral direction of the elevator car 1 at the position of the elevator car 1 in association with each other, and the control unit 24*b* extracts, based on the position of the elevator car 1 detected by the position detecting unit 22, the acceleration in the lateral direction of the elevator car 1 stored in association with the stored position of the elevator car 1 corresponding to the position of the elevator car 1 where the elevator car 1 is about to pass from the storage unit 24*a*, and controls the drive units 21*a* and 21*b* so as to adjust the pressing force of the guide units 3*a* and 3*b* against the guide rails 2 to a pressing force that is derived based on at least the extracted acceleration in the lateral direction of the elevator car 1, in response to the detection of the position of the elevator car 1 by the position detecting unit 22.

That is, the control unit 24*b* extracts in advance, based on the detection result by the position detecting unit 22 and the information stored in the storage unit 24*a*, the acceleration in the lateral direction of the elevator car 1 stored in association with the position of the elevator car 1 in the vertical direction within the shaft 7 corresponding to the position where the elevator car 1, which is moving up and down within the shaft 7, is about to pass before the position where the elevator car 1 is about to pass is reached, and controls the drive units 21*a* and 21*b* at the timing at which the elevator car 1 reaches the position where the elevator car 1 is about to pass.

Accordingly, the guide units 3*a* and 3*b* whose pressing force against the guide rails 2 is adjusted by the drive units 21*a* and 21*b* exert a pressing force corresponding to the actual position of the elevator car 1 against the guide rails 2. As a result, the force in the lateral direction due to rolling of the elevator car 1 during elevation counteracts a part or the whole of the reaction force of the pressing force of the guide units 3*a* and 3*b* against the guide rails 2, so that the rolling of the elevator car 1 is practically restricted.

Further, in the above-described embodiments, the control unit 24*b* controls the drive units 21*a* and 21*b* so as to adjust the pressing force of the guide units 3*a* and 3*b* against the guide rails 2 to a pressing force that is derived based on the extracted acceleration in the lateral direction of the elevator car 1, in response to the detection of the position of the elevator car 1 by the position detecting unit 22, when the elevation speed of the elevator car 1 is a specific speed. Accordingly, the control unit 24*b* restricts the rolling of the elevator car 1 by controlling the drive units 21*a* and 21*b* when the elevation speed of the elevator car 1 is a specific speed. Generally, a user feels rolling of the elevator car 1 more at a high elevation speed of the elevator car 1 than at a low elevation speed of the elevator car 1. As a result, even when the elevation speed of the elevator car 1 is the specific speed that makes the user feel uncomfortable, the uncomfortable feeling of the user can be suppressed to the minimum.

Further, the car rolling suppression device 18 according to the above-described embodiments includes acceleration measuring units 25 configured to measure the acceleration in the lateral direction of the elevator car 1, the acceleration measuring units 25 measure the acceleration in the lateral direction of the elevator car 1 during elevation, and the control unit 24*b* rewrites the acceleration of the elevator car 1 that is stored in the storage unit 24*a* in association with the stored position of the elevator car 1 in the vertical direction corresponding to the position of the elevator car 1 detected by the position detecting unit 22, with the acceleration of the elevator car 1 detected by the acceleration measuring units 25. In this way, the control unit 24*b* rewrites the acceleration of the elevator car 1 stored in the storage unit 24*a* with the acceleration of the elevator car 1 measured by the acceleration measuring units 25, and therefore the acceleration of the elevator car 1 stored in the storage unit 24*a* fits the actual rolling of the elevator car 1. Accordingly, even if the form of rolling of the elevator car 1 changes due to the deterioration with age, the use state, or the like of each device constituting the elevator, the control unit 24*b* extracts the acceleration of the elevator car 1 that fits the actual rolling of the elevator car 1 and controls the drive units 21*a* and 21*b* based thereon. Thus, the rolling of the elevator car 1 is practically restricted.

Further, the car rolling suppression device 18 according to the above-described embodiments includes the acceleration measuring units 25 configured to measure the acceleration in the lateral direction of the elevator car 1, and the control unit 24*b* controls the drive units 21*a* and 21*b* so as to adjust the pressing force of the guide units 3*a* and 3*b* against the guide rails 2 to a total pressing force of a pressing force that is derived based on the acceleration in the lateral direction of the elevator car 1 extracted from the storage unit 24*a* and a force that is derived from the acceleration measured by the acceleration measuring units 25, in response to the detection of the position of the elevator car 1 by the position detecting unit 22. Therefore, the car rolling suppression device 18 according to the above-described embodiments can reliably restrict rolling of the elevator car 1, even if the form of rolling of the elevator car 1 changes due to the deterioration with age, the use state, or the like of each device constituting the elevator.

Specifically, the control unit 24*b* controls the drive units 21*a* and 21*b* so as to adjust the pressing force of the guide units 3*a* and 3*b* against the guide rails 2 to a pressing force that is derived based on the acceleration of the elevator car 1 that is stored in the storage unit 24*a* in association with the stored position in the vertical direction corresponding to the position of the elevator car 1 detected by the position detecting unit 22.

In this state, the drive units 21*a* and 21*b* are controlled based on the information stored in the storage unit 24*a*, and therefore if the form of rolling of the elevator car 1 does not change from the form of rolling of the elevator car 1 at the time when the information has been stored in the storage unit 24*a*, the car rolling suppression device 18 prevents the elevator car 1 during elevation from rolling.

However, in an elevator, the form of rolling of the elevator car 1 may sometimes change due to the deterioration with age, the use state, or the like of each device, and thus the acceleration in the lateral direction due to the rolling of the elevator car 1 which has been stored in the storage unit 24*a* may be different from the actual acceleration in the lateral direction due to the rolling of the elevator car 1 in some cases. In such a case, the pressing force of the guide units 3*a* and 3*b* against the guide rails 2 may be excessive or deficient if the guide units 3*a* and 3*b* are pressed against the guide rails 2 with a pressing force that is derived based on the acceleration in the lateral direction due to the rolling of the elevator car 1 stored in the storage unit 24*a*, so that the rolling of the elevator car 1 may fail to be sufficiently restricted.

In the above-described embodiments, the acceleration of the elevator car 1 is measured by the acceleration measuring units 25 while the control unit 24*b* causes the guide units 3 to be pressed against the car guide rails 2 with the pressing force that is derived based on the acceleration of the elevator car 1 stored in the storage unit 24*a*, and therefore the measurement result is equal to the difference between the acceleration in the lateral direction due to the rolling of the elevator car 1 which has been stored in the storage unit 24*a* and the actual acceleration in the lateral direction due to the rolling of the elevator car 1 (varied acceleration).

Accordingly, the control unit 24*b* controls the drive units 21*a* and 21*b* so as to adjust the pressing force of the guide units 3*a* and 3*b* against the guide rails 2 to the total pressing force of a pressing force that is derived based on the extracted acceleration in the lateral direction of the elevator car 1 and a force that is derived from the acceleration measured by the acceleration measuring units 25, in response to the detection of the position of the elevator car 1 by the position detecting unit 22, thereby allowing the guide units 3*a* and 3*b* to be pressed against the guide rails 2 with a pressing force obtained by taking the change in the form of rolling of the elevator car 1 into account.

That is, the control unit 24*b* controls the drive units 21*a* and 21*b* by taking the difference between the actual acceleration of the elevator car 1 and the acceleration of the elevator car 1 stored in the storage unit 24*a* into account as a correction value, and therefore the rolling of the elevator car 1 is practically restricted, even if the form of rolling of the elevator car 1 changes due to the deterioration with age, the use state, or the like.

The car rolling suppression method according to the above-described embodiments includes: detecting a position of the elevator car 1 in the vertical direction within the shaft 7 by the position detecting unit 22, the elevator car 1 being provided to be elevatable within the shaft 7 provided in a building; extracting an acceleration in the lateral direction of the elevator car 1 stored in association with the stored position of the elevator car 1 corresponding to the position of the elevator car 1 detected by the position detecting unit 22 from the storage unit 24*a* that has stored in advance the position of the elevator car 1 in the vertical direction within the shaft 7 and the acceleration in the lateral direction of the elevator car 1 at the position of the elevator car 1 in association with each other; and controlling the drive units 21*a* and 21*b* so as to adjust the pressing force of the guide units 3*a* and 3*b* that are provided to be movable along the guide rails 2 extending in the vertical direction along the shaft 7 and are configured to restrict movement of the elevator car 1 in the lateral direction orthogonal to the vertical direction against the guide rails 2 to a pressing force that is derived based on at least the acceleration in the lateral direction of the elevator car 1 extracted from the storage unit 24*a*, in response to the detection of the position of the elevator car 1 by the position detecting unit 22.

According to such a configuration, the acceleration in the lateral direction of the elevator car 1 stored in association with the stored position in the vertical direction within the shaft 7 corresponding to the position where the elevator car 1, which is moving up and down within the shaft 7, is about to pass is extracted in advance before the position where the elevator car 1 is about to pass is reached, based on the detection result by the position detecting unit 22 and the information stored in the storage unit 24*a*, and the drive units 21*a* and 21*b* are controlled so as to adjust the pressing force of the guide units 3*a* and 3*b* against the guide rails 2 to a pressing force that is derived based on at least the acceleration in the lateral direction of the elevator car 1 extracted from the storage unit 24*a*. Therefore, the drive units 21*a* and 21*b* are controlled at the timing at which the elevator car 1 reaches the position where the elevator car 1 is about to pass.

Accordingly, the guide units 3*a* and 3*b* whose pressing force against the guide rails 2 is adjusted by the drive units 21*a* and 21*b* exert a pressing force corresponding to the actual position of the elevator car 1 against the guide rails 2. As a result, the force in the lateral direction due to rolling of the elevator car 1 during elevation counteracts a part or the whole of the reaction force of the pressing force of the guide units 3*a* and 3*b* against the guide rails 2, so that the rolling of the elevator car 1 is practically restricted.

The present invention is not limited to the aforementioned embodiments, and various modifications can be made without departing from the gist of the present invention.

In the above-described embodiments, an elevator having the hoisting machine 8 and the like arranged in the machine room that is provided on the rooftop of the building has been described. However, there is no limitation to this. For example, the car rolling suppression device 18 may be employed for a so-called machine room-less type elevator without having a machine room.

In the above-described embodiments, roller guides are employed as the guide units 3. However, there is no limitation to this. For example, the guide units 3 may be sliding guides configured to allow sliding on the guide surfaces 17 of the guide rails 2 in the vertical direction.

In the above-described embodiments, although there is no particular mention, the guide units 3 may be fixed directly to the elevator car 1, or may be fixed to the elevator car 1 via an attenuation device that attenuates vibration of the elevator car 1. In this case, the rolling of the elevator car 1 means the rolling of the elevator car 1 after being attenuated by the attenuation device. That is, the car rolling suppression device 18 can be used in combination with the attenuation device.

In the above-described embodiments, the drive units 21 are provided corresponding respectively to the guide units 3 located in the lower part of the elevator car 1. However, there is no limitation to this. For example, the drive units 21 may be provided corresponding respectively to all the guide units 3 provided in the elevator car 1. Further, the drive units 21 may be provided corresponding respectively to the guide units 3 located in the upper part of the elevator car 1.

In the above-described embodiments, the position detecting unit 22 is constituted by the detection object 22*a* composed of an elongated tape on which a plurality of two-dimensional barcodes are printed and the detection unit 22*b* configured to read the detection object 22*a*. However, there is no limitation to this. For example, the position detecting unit may be a magnetic sensor, an optical sensor, an ultrasonic sensor, or the like.

In the above-described embodiments, the speed measuring unit 26 is separated from the control units. However, there is no limitation to this. For example, the control unit 24*b* may have a function as the speed measuring unit 26 to measure the elevation speed of the elevator car 1. Specifically, the control unit 24*b* may also have the function of the speed measuring unit 26 by being configured to calculate the moving distance of the elevator car 1 based on the result the position of the elevator car 1 by the position detecting unit 22 and to measure the time for the elevator car 1 to move the calculated moving distance, so as to calculate the elevation speed of the elevator car 1 based thereon.

In the above-described embodiments, acceleration sensors are employed as the acceleration measuring units 25.

However, there is no limitation to this. For example, the acceleration measuring units may be gyro sensors.

In the above-described embodiments, the acceleration of the elevator car 1 stored in the storage unit 24*a* is actually measured by the acceleration measuring units 25 of the car rolling suppression device 18. However, there is no limitation to this. For example, the acceleration of the elevator car 1 stored in the storage unit 24*a* may be measured by an independent measuring device mounted on the elevator car 1 separately from the car rolling suppression device 18. Also in this case, the acceleration of the elevator car 1 is, of course, measured before the normal operation of the elevator car 1 and stored in the storage unit 24*a*.

In the above-described embodiments, the acceleration of the elevator car 1 stored in the storage unit 24*a* is actually measured (measured) during the test operation before the normal operation. However, there is no limitation to this. For example, the acceleration of the elevator car 1 stored in the storage unit 24*a* may be measured during a periodic inspection of the elevator.

In the above-described embodiments, the acceleration of the elevator car 1 stored in the storage unit 24*a* is rewritten with the acceleration of the elevator car 1 measured continuously during the normal operation by the acceleration measuring units 25. However, there is no limitation to this. For example, the acceleration of the elevator car 1 stored in the storage unit 24*a* may be rewritten with the acceleration of the elevator car 1 measured intermittently (for example, every certain time) during the normal operation by the acceleration measuring units 25. Also in this way, the acceleration of the elevator car 1 stored in the storage unit 24*a* fits the actual situation, and therefore the control unit 24*b* controls the drive units 21 based on this, so that the rolling of the elevator car 1 can be practically restricted.

In the above-described embodiments, the control pattern of the drive units 21 is selected from the first control pattern (pattern performing only feedforward control) or the second control pattern (pattern combining feedforward control and feedback control) depending on the conditions. However, there is no limitation to this. For example, the control pattern of the drive units 21 may be only the first control pattern. That is, the control unit 24*b* may be configured to perform only feedforward control on the drive units 21.

In the above-described embodiments, the control unit 24*b* is configured to calculate the propulsion amount of the guide units 3 corresponding to the pressing force that is derived based on the acceleration of the elevator car 1. However, there is no limitation to this. For example, the propulsion amount of the guide units 3 in which the drive units 21 can exert the pressing force that is derived based on the acceleration of the elevator car 1 is stored in advance in the storage unit 24*a*, and when the acceleration of the elevator car 1 is stored in the storage unit 24*a*, the acceleration of the elevator car 1 and the propulsion amount of the guide units 3 are associated with each other, so that the control unit 24*b* controls the drive units 21 based on the propulsion amount of the guide units 3 stored in the storage unit 24*a* during the normal operation.

In the above-described embodiments, the control unit 24*b* is configured to determine the elevation state of the elevator car 1 based on the control signal from the elevator control device 40. However, there is no limitation to this. For example, the control unit 24*b* may determine the elevation state of the elevator car 1 based on the detection result (the position of the elevator car 1) by the position detecting unit 22.

In the above-described embodiments, the position of the elevator car 1 in the vertical direction within the shaft 7, the elevation state of the elevator car 1, the elevation speed of the elevator car 1, and the acceleration of the elevator car 1 are stored in the storage unit 24*a*, then the acceleration of the elevator car 1 associated with information corresponding to the position of the elevator car 1 detected by the position detecting unit 22, the elevation state of the elevator car 1 as a determination result, or the like is extracted from the storage unit 24*a*, and the drive units 21 are controlled based thereon. However, there is no limitation to this.

That is, the configuration may be such that the storage unit 24*a* stores at least the position of the elevator car 1 and the acceleration of the elevator car 1 at the position of the elevator car 1 in association with each other, the control unit 24*b* extracts, based on the position of the elevator car 1 detected by the position detecting unit 22, the acceleration of the elevator car 1 stored in association with the stored corresponding position of the elevator car 1 from the storage unit 24*a*, and controls the drive units 21 so as to adjust the pressing force of the guide units 3 against the car guide rails 2 to a pressing force that is derived based on at least the extracted acceleration of the elevator car 1, in response to the detection of the position of the elevator car 1 by the position detecting unit 22.

What is claimed is:

1. An elevator car rolling suppression device comprising:

a drive unit attached to an elevator car provided to be elevatable within a shaft provided in a building, the drive unit being configured to press, against a guide rail, a guide unit provided to be movable along the guide rail extending in the vertical direction along the shaft, the guide unit being configured to restrict movement of the elevator car in the lateral direction orthogonal to the vertical direction;

a position detecting unit configured to detect a position of the elevator car in the vertical direction within the shaft;

a speed measuring unit configured to measure an elevation speed of the elevator car;

a storage unit configured to store in advance a plurality of elevation patterns in each of which at least one of the departure floor and the destination floor of the elevator car is different, and the elevation speed of the elevator car at a specific position in the vertical direction within the shaft is different, and further to store in advance the position of the elevator car in the vertical direction within the shaft and the acceleration in the lateral direction of the elevator car at the position of the elevator car for each of the plurality of elevation patterns in association with each other; and a control unit configured to extract, based on the position of the elevator car detected by the position detecting unit and the elevation speed of the elevator car measured by the speed measuring unit, the elevation pattern from the storage unit, further extracts, based on the position of the elevator car detected by the position detecting unit and the extracted elevation pattern, the acceleration of the elevator car in the lateral direction stored in association with the stored position of the elevator car corresponding to the position of the elevator car detected by the position detecting unit from the storage unit, and controls the drive unit so as to adjust the pressing force of the guide unit against the guide rail to a pressing force that is derived based on the extracted acceleration in the lateral direction of the elevator car, in response to the detection of the position of the elevator car by the position detecting unit.

2. An elevator car rolling suppression device comprising:

a drive unit attached to an elevator car provided to be elevatable within a shaft provided in a building, the drive unit being configured to press, against a guide rail, a guide unit provided to be movable along the guide rail extending in the vertical direction along the shaft, the guide unit being configured to restrict movement of the elevator car in the lateral direction orthogonal to the vertical direction;

a position detecting unit configured to detect a position of the elevator car in the vertical direction within the shaft;

a storage unit configured to store in advance the position of the elevator car in the vertical direction within the shaft and an acceleration in the lateral direction of the elevator car at the position of the elevator car in association with each other; and a control unit configured to extract, based on the position of the elevator car detected by the position detecting unit, the acceleration in the lateral direction of the elevator car stored in association with the stored position of the elevator car corresponding to the position of the elevator car where the elevator car is about to pass from the storage unit, and to control the drive unit so as to adjust the pressing force of the guide unit against the guide rail to a pressing force that is derived based on the extracted acceleration in the lateral direction of the elevator car, in response to the detection of the position of the elevator car by the position detecting unit, when the elevation speed of the elevator car is a specific speed.

3. The elevator car rolling suppression device according to claim 1, wherein the control unit controls the drive unit so as to adjust the pressing force of the guide unit against the guide rail to a pressing force that is derived based on the extracted acceleration in the lateral direction of the elevator car, in response to the detection of the position of the elevator car by the position detecting unit, when the elevation speed of the elevator car is a specific speed.

4. The elevator car rolling suppression device according to claim 1, further comprising:

an acceleration measuring unit configured to measure the acceleration in the lateral direction of the elevator car, wherein the acceleration measuring unit measures the acceleration in the lateral direction of the elevator car during elevation, and the control unit rewrites the acceleration of the elevator car that is stored in the storage unit in association with the stored position of the elevator car in the vertical direction corresponding to the position of the elevator car detected by the position detecting unit, with the acceleration of the elevator car detected by the acceleration measuring unit.

5. The elevator car rolling suppression device according to claim 2, further comprising:

an acceleration measuring unit configured to measure the acceleration in the lateral direction of the elevator car, wherein the acceleration measuring unit measures the acceleration in the lateral direction of the elevator car during elevation, and the control unit rewrites the acceleration of the elevator car that is stored in the storage unit in association with the stored position of the elevator car in the vertical direction corresponding to the position of the elevator car detected by the position detecting unit, with the acceleration of the elevator car detected by the acceleration measuring unit.

6. The elevator car rolling suppression device according to claim 3, further comprising:

an acceleration measuring unit configured to measure the acceleration in the lateral direction of the elevator car, wherein the acceleration measuring unit measures the acceleration in the lateral direction of the elevator car during elevation, and the control unit rewrites the acceleration of the elevator car that is stored in the storage unit in association with the stored position of the elevator car in the vertical direction corresponding to the position of the elevator car detected by the position detecting unit, with the acceleration of the elevator car detected by the acceleration measuring unit.

7. The elevator car rolling suppression device according to claim 1, further comprising:

an acceleration measuring unit configured to measure the acceleration in the lateral direction of the elevator car, wherein the control unit controls the drive unit so as to adjust the pressing force of the guide unit against the guide rail to a total pressing force of a pressing force that is derived based on the acceleration in the lateral direction of the elevator car extracted from the storage unit and a force that is derived from the acceleration measured by the acceleration measuring unit, in response to the detection of the position of the elevator car by the position detecting unit.

8. The elevator car rolling suppression device according to claim 2, further comprising:

an acceleration measuring unit configured to measure the acceleration in the lateral direction of the elevator car, wherein the control unit controls the drive unit so as to adjust the pressing force of the guide unit against the guide rail to a total pressing force of a pressing force that is derived based on the acceleration in the lateral direction of the elevator car extracted from the storage unit and a force that is derived from the acceleration measured by the acceleration measuring unit, in response to the detection of the position of the elevator car by the position detecting unit.

9. The elevator car rolling suppression device according to claim 3, further comprising:

an acceleration measuring unit configured to measure the acceleration in the lateral direction of the elevator car, wherein the control unit controls the drive unit so as to adjust the pressing force of the guide unit against the guide rail to a total pressing force of a pressing force that is derived based on the acceleration in the lateral direction of the elevator car extracted from the storage unit and a force that is derived from the acceleration measured by the acceleration measuring unit, in response to the detection of the position of the elevator car by the position detecting unit.

10. The elevator car rolling suppression device according to claim 4, wherein the control unit controls the drive unit so as to adjust the pressing force of the guide unit against the guide rail to a total pressing force of a pressing force that is derived based on the acceleration in the lateral direction of the elevator car extracted from the storage unit and a force that is derived from the acceleration measured by the acceleration measuring unit, in response to the detection of the position of the elevator car by the position detecting unit.

11. The elevator car rolling suppression device according to claim 5, wherein the control unit controls the drive unit so as to adjust the pressing force of the guide unit against the guide rail to a total pressing force of a pressing force that is derived based on the acceleration in the lateral direction of the elevator car extracted from the storage unit and a force that is derived from the acceleration measured by the acceleration measuring unit, in response to the detection of the position of the elevator car by the position detecting unit.

12. The elevator car rolling suppression device according to claim 6, wherein the control unit controls the drive unit so as to adjust the pressing force of the guide unit against the guide rail to a total pressing force of a pressing force that is derived based on the acceleration in the lateral direction of the elevator car extracted from the storage unit and a force that is derived from the acceleration measured by the acceleration measuring unit, in response to the detection of the position of the elevator car by the position detecting unit.

13. An elevator car rolling suppression method comprising:

detecting a position of an elevator car in the vertical direction within a shaft provided in a building by a position detecting unit, the elevator car being provided to be elevatable within the shaft;

storing in advance a plurality of elevation patterns in each of which at least one of the departure floor and the destination floor of the elevator car is different, and the elevation speed of the elevator car at a specific position in the vertical direction within the shaft is different;

extracting, from a storage unit that has stored in advance the position of the elevator car in the vertical direction within the shaft and an acceleration in the lateral direction of the elevator car at the stored position of the elevator car for each of the plurality of elevation patterns in association with each other, the acceleration in the lateral direction of the elevator car stored in association with the stored position of the elevator car corresponding to the position of the elevator car detected by the position detecting unit;

extracting, based on the position of the elevator car detected by the position detecting unit and the elevation speed of the elevator car measured by a speed measuring unit configured to measure an elevation speed of the elevator car, the elevation pattern from the storage unit;

further extracting, based on the position of the elevator car detected by the position detecting unit and the extracted elevation pattern, the acceleration of elevator car in the lateral direction stored in association with the stored position of the elevator car corresponding to the position of the elevator car detected by the position detecting unit from the storage unit; and controlling a drive unit so as to adjust a pressing force of a guide unit against a guide rail, the guide unit being provided to be movable along the guide rail extending in the vertical direction along the shaft and being configured to restrict movement of the elevator car in the lateral direction orthogonal to the vertical direction to a pressing force that is derived based on the acceleration in the lateral direction of the elevator car extracted from the storage unit, in response to the detection of the position of the elevator car by the position detecting unit.

14. An elevator car rolling suppression method comprising:

detecting a position of an elevator car in the vertical direction within a shaft provided in a building by a position detecting unit, the elevator car being provided to be elevatable within the shaft;

extracting, from a storage unit that has stored in advance the position of the elevator car in the vertical direction within the shaft and an acceleration in the lateral direction of the elevator car at the stored position of the elevator car in association with each other, the acceleration in the lateral direction of the elevator car stored in association with the stored position of the elevator car corresponding to the position of the elevator car detected by the position detecting unit; and controlling a drive unit so as to adjust a pressing force of a guide unit against a guide rail, the guide unit being provided to be movable along a guide rail extending in the vertical direction along the shaft and being configured to restrict movement of the elevator car in the lateral direction orthogonal to the vertical direction to a pressing force that is derived based on the acceleration in the lateral direction of the elevator car extracted from the storage unit, in response to the detection of the position of the elevator car by the position detecting unit, when the elevation speed of the elevator car is a specific speed.

* * * * *